US007978211B2

(12) United States Patent
Chen et al.

(10) Patent No.: US 7,978,211 B2
(45) Date of Patent: Jul. 12, 2011

(54) LIQUID CRYSTAL DISPLAY DEVICE AND RELATED OPERATING METHOD

(75) Inventors: Yu-Yeh Chen, Tainan (TW); Po-Yang Lin, Tainan (TW); Chin-Cheng Tsai, Tainan (TW)

(73) Assignee: Chimei Innolux Corporation, Miao-Li County (TW)

( * ) Notice: Subject to any disclaimer, the term of this patent is extended or adjusted under 35 U.S.C. 154(b) by 915 days.

(21) Appl. No.: 11/975,084

(22) Filed: Oct. 17, 2007

(65) Prior Publication Data

US 2008/0088650 A1 Apr. 17, 2008

(30) Foreign Application Priority Data

Oct. 17, 2006 (TW) ..... 95138282 A

(51) Int. Cl.
*G09G 5/10* (2006.01)

(52) U.S. Cl. ..... 345/690; 345/89

(58) Field of Classification Search ..... 345/89, 345/690
See application file for complete search history.

(56) References Cited

U.S. PATENT DOCUMENTS

2006/0238552 A1* 10/2006 Chuang et al. ..... 345/690
2007/0063947 A1* 3/2007 Kang ..... 345/89
2007/0165051 A1* 7/2007 Yamada ..... 345/690

* cited by examiner

*Primary Examiner* — Alexander Eisen
*Assistant Examiner* — Robin Mishler
(74) *Attorney, Agent, or Firm* — Trop, Pruner & Hu, P.C.

(57) ABSTRACT

In a liquid crystal display (LCD) device, a plurality of pixels is driven to display a first frame and a second frame in sequence. A gray-scale difference between the first frame and the second frame is detected to determine a driving mode variation between the first frame and the second frame. The number of pixels driven by a dynamic mode and a static mode in the second frame is adjusted according to the driving mode variation. Gray-scale data corresponding to the pixels in the second frame is output.

20 Claims, 12 Drawing Sheets

110

| original gray-scale | first sub-frame | second sub-frame |
|---|---|---|
| 0 | 0 | 0 |
| 1 | 2 | 0 |
| ⋮ | ⋮ | ⋮ |
| 149 | 245 | 0 |
| 150 | 250 | 0 |
| 151 | 255 | 0 |
| 152 | 255 | 5 |
| ⋮ | ⋮ | ⋮ |
| 254 | 255 | 240 |
| 255 | 255 | 250 |

| | |
|---|---|
| 1 | 0 |
| 0 | 0 |

| | |
|---|---|
| 1 | 0 |
| 0 | 1 |

| | |
|---|---|
| 1 | 0 |
| 1 | 1 |

| | |
|---|---|
| 1 | 1 |
| 1 | 1 |

| | | | | | | | |
|---|---|---|---|---|---|---|---|
| 1 | 0 | 0 | 0 | 0 | 0 | 0 | 0 |
| 0 | 0 | 0 | 1 | 0 | 0 | 0 | 0 |
| 0 | 0 | 0 | 0 | 0 | 0 | 0 | 1 |
| 0 | 0 | 0 | 0 | 0 | 0 | 0 | 0 |
| 1 | 0 | 0 | 0 | 1 | 0 | 0 | 0 |
| 0 | 0 | 0 | 0 | 0 | 0 | 1 | 0 |
| 0 | 0 | 1 | 0 | 0 | 0 | 0 | 0 |
| 0 | 0 | 0 | 0 | 0 | 1 | 0 | 0 |

FIG. 13A

| | | | | | | | |
|---|---|---|---|---|---|---|---|
| 1 | 0 | 0 | 0 | 1 | 0 | 1 | 0 |
| 0 | 1 | 0 | 1 | 0 | 0 | 0 | 0 |
| 0 | 0 | 0 | 0 | 0 | 1 | 0 | 1 |
| 0 | 0 | 1 | 0 | 0 | 0 | 0 | 0 |
| 1 | 0 | 0 | 0 | 1 | 0 | 0 | 0 |
| 0 | 0 | 0 | 1 | 0 | 0 | 1 | 0 |
| 1 | 0 | 1 | 0 | 0 | 0 | 0 | 0 |
| 0 | 0 | 0 | 1 | 0 | 1 | 0 | 0 |

FIG. 13B

| | | | | | | | |
|---|---|---|---|---|---|---|---|
| 1 | 0 | 1 | 0 | 1 | 0 | 1 | 0 |
| 0 | 1 | 0 | 1 | 0 | 0 | 0 | 0 |
| 0 | 1 | 0 | 0 | 1 | 1 | 0 | 1 |
| 0 | 0 | 1 | 0 | 0 | 0 | 1 | 0 |
| 1 | 0 | 0 | 0 | 1 | 0 | 0 | 0 |
| 0 | 1 | 0 | 1 | 0 | 0 | 1 | 0 |
| 1 | 0 | 1 | 0 | 1 | 0 | 0 | 0 |
| 0 | 1 | 0 | 1 | 0 | 1 | 0 | 1 |

FIG. 13C

| | | | | | | | |
|---|---|---|---|---|---|---|---|
| 1 | 0 | 1 | 0 | 1 | 0 | 1 | 0 |
| 0 | 1 | 0 | 1 | 0 | 0 | 1 | 0 |
| 0 | 1 | 0 | 0 | 1 | 1 | 0 | 1 |
| 1 | 0 | 1 | 1 | 0 | 1 | 1 | 0 |
| 1 | 0 | 1 | 0 | 1 | 0 | 0 | 1 |
| 0 | 1 | 0 | 1 | 0 | 1 | 1 | 0 |
| 1 | 0 | 1 | 0 | 1 | 0 | 1 | 0 |
| 0 | 1 | 0 | 1 | 0 | 1 | 0 | 1 |

FIG. 13D

| | | | | | | | |
|---|---|---|---|---|---|---|---|
| 1 | 0 | 1 | 0 | 1 | 1 | 1 | 0 |
| 1 | 1 | 1 | 1 | 0 | 0 | 1 | 0 |
| 0 | 1 | 0 | 1 | 1 | 1 | 0 | 1 |
| 1 | 0 | 1 | 1 | 0 | 1 | 1 | 0 |
| 1 | 1 | 1 | 0 | 1 | 1 | 0 | 1 |
| 0 | 1 | 0 | 1 | 0 | 1 | 1 | 1 |
| 1 | 0 | 1 | 0 | 1 | 0 | 1 | 0 |
| 0 | 1 | 1 | 1 | 0 | 1 | 0 | 1 |

FIG. 13E

| | | | | | | | |
|---|---|---|---|---|---|---|---|
| 1 | 0 | 1 | 0 | 1 | 1 | 1 | 0 |
| 1 | 1 | 1 | 1 | 1 | 0 | 1 | 1 |
| 0 | 1 | 0 | 1 | 1 | 1 | 1 | 1 |
| 1 | 1 | 1 | 1 | 0 | 1 | 1 | 0 |
| 1 | 1 | 1 | 0 | 1 | 1 | 0 | 1 |
| 0 | 1 | 1 | 1 | 1 | 1 | 1 | 1 |
| 1 | 0 | 1 | 0 | 1 | 1 | 1 | 0 |
| 1 | 1 | 1 | 1 | 0 | 1 | 0 | 1 |

FIG. 13F

| | | | | | | | |
|---|---|---|---|---|---|---|---|
| 1 | 1 | 1 | 1 | 1 | 1 | 1 | 0 |
| 1 | 1 | 1 | 1 | 1 | 0 | 1 | 1 |
| 0 | 1 | 0 | 1 | 1 | 1 | 1 | 1 |
| 1 | 1 | 1 | 1 | 1 | 1 | 1 | 1 |
| 1 | 1 | 1 | 1 | 1 | 1 | 0 | 1 |
| 0 | 1 | 1 | 1 | 1 | 1 | 1 | 1 |
| 1 | 1 | 1 | 1 | 1 | 1 | 1 | 0 |
| 1 | 1 | 1 | 1 | 0 | 1 | 1 | 1 |

FIG. 13G

| | | | | | | | |
|---|---|---|---|---|---|---|---|
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |

FIG. 13H

| original gray-scale | first sub-frame | second sub-frame |
|---|---|---|
| 0 | 0 | 0 |
| 1 | 1 | 1 |
| ·<br>· | ·<br>· | ·<br>· |
| 149 | 150 | 148 |
| 150 | 152 | 149 |
| 151 | 153 | 150 |
| 152 | 153 | 151 |
| ·<br>· | ·<br>· | ·<br>· |
| 254 | 253 | 252 |
| 255 | 254 | 253 |

FIG. 14

LIQUID CRYSTAL DISPLAY DEVICE AND RELATED OPERATING METHOD

CROSS REFERENCE TO RELATED APPLICATION

This claims priority under 35 U.S.C. §119 to Taiwan Application No. 095138282, filed Oct. 17, 2006, which is hereby incorporated by reference.

BACKGROUND OF THE INVENTION

The invention relates to a liquid crystal display (LCD) device and a driving method thereof, and, in particular, to a LCD device and an image display method applying black/gray insertion technology.

In order to enhance the display quality of a liquid crystal display (LCD) device, a display duty cycle may be shortened by adding a sub-frame. This method is sometimes referred to as impulse-like LCD technology. Specifically, a normally black sub-frame is often added and the technology is referred to as black insertion or gray insertion technology.

In the conventional image display method of a LCD device, pixels on a display surface in the same frame are commonly driven by either a dynamic mode (e.g., pixel data changes in sequential frames) or static mode (e.g., pixel data does not change in sequential frames) according to a dynamic or static property of the frame. The black/gray frame inserting method is used when the pixels are to be driven by the dynamic mode. Black/gray frame insertion helps avoid blurring that may be associated with dynamic modes and LCDs, as is commonly understood by those of ordinary skill in the art. Such blurring is not typical with impulse devices such as cathode ray tubes (CRTs). No dark frame is inserted when pixels are driven by the static mode, in contrast to dynamic mode, because blurring is typically not an issue with motionless situations (e.g., when there is little difference between successive frames).

As shown in FIG. 1, two adjacent pixels 101 and 102 respectively receive gray-scale data A and B and display the gray-scale data A and B in the same frame time $T_f$. A first conventional image display technology of the impulse-like LCD device, designed to address the aforementioned blurring issue, is shown in FIG. 2. As briefly described above, a normally black sub-frame with gray-scale value of 0 is added when the pixels 101 and 102 receive gray-scale data A and B respectively, wherein traditional image frequency doubling technology is applied. Thus, pixels 101 and 102 only display the sub-frames with the gray-scale data of A and B in the first half-frame time and display the black frames (corresponding to the gray-scale value 0) in the second half-frame time, as shown in FIG. 2. The black frame inserting method can effectively halve the blur width, as judged according to traditional eye-tracking models that are associated with LCDs operating in dynamic mode. However, due to the black frame insertion, the frame luminance is halved and the image quality is lessened.

To avoid this reduction of frame luminance, a second conventional image display technology for impulse-like LCD devices has been implemented. As shown in FIG. 3, when pixels 101 and 102 receive gray-scale data A and B, respectively, the second conventional method enables the pixel 101 to display the sub-frames A' and C in sequence and the pixel 102 to display the sub-frames B' and D in sequence according to a predetermined rule (see below). In the frame time $T_f$, the pixel 101 displays the average luminance of the sub-frames A' and C, which may compare to or equal the luminance obtained in FIG. 1 when the gray-scale data A is directly displayed during the whole frame time $T_f$. Similarly, the pixel 102 displays the average luminance of the sub-frames B' and D in the frame time $T_f$, which may compare to or equal the luminance obtained in FIG. 1 when the gray-scale data B is directly displayed during the whole frame time $T_f$.

As shown in FIG. 4, a look-up table 110 is an example of the aforementioned predetermined rule used in the method of FIG. 3. The table may be used to generate the sub-frame data. For example, two sub-frames with the gray-scale data of 250 and 0 in sequence will be output when a pixel receives the original gray-scale data of 150, and two sub-frames with the gray-scale data of 255 and 0 will be output in sequence when the pixel receives the original gray-scale data of 151. In the look-up table 110 of FIG. 4, when the original gray-scale value is smaller than 152, a second sub-frame with the gray-scale data of 0 (a black frame) and a corresponding first sub-frame are generated so that the resultant luminance effect of the two sub-frames is equal to the luminance of the original gray-scale value. When the original gray-scale value is greater than 151, a first sub-frame with the gray-scale data of 255 and a corresponding second sub-frame are added such that the resultant luminance effect of the two sub-frames is equal to the luminance of the original gray-scale value. Generally, the gray-scale values of the adjacent pixels 101 and 102 are very close to each other. Thus, if the original gray-scale values of the pixels 101 and 102 in FIG. 3 are smaller than 152, the gray-scale values C and D of the sub-frame are equal to 0. If the original gray-scale values of the pixels 101 and 102 are greater than 151, the gray-scale values A' and B' of the sub-frame are equal to 255. Each of these two conditions can effectively reduce the blur width of the dynamic image without influencing the luminance of displaying image.

In the second conventional technology when the image is continuously in the moving situation, replacing the black frame insertion with the gray frame insertion can indeed improve the flicker of the moving frame. However, when the image is changed from the moving situation to the motionless situation instantaneously, all the pixels originally driven by the dynamic mode are driven by the static mode. Consequently, the luminance of the whole image suddenly increases because no gray frame is inserted after the image is converted into the static one, and the viewer may notice the luminance surge in the generated image. Thus, the image display quality of the LCD device may be lessened.

BRIEF SUMMARY OF THE INVENTION

An embodiment of the invention includes a method of driving pixels of a liquid crystal display (LCD) device when displaying a first frame and a second frame in sequence. The method includes: (a) detecting a gray-scale difference between the first frame and the second frame; (b) determining a driving mode change between the first frame and the second frame based on the detected gray-scale difference; (c) adjusting a ratio of first pixels, which are driven by a dynamic mode and are included in the plurality of pixels, to second pixels, which are driven by a static mode and are included in the plurality of pixels, in the second frame based on the determined driving mode change; and (d) outputting gray-scale data based on the adjusted ratio. Other embodiments are included herein.

BRIEF DESCRIPTION OF THE DRAWINGS

The accompanying drawings, incorporated in and constituting a part of this specification, may illustrate one or more implementations consistent with the principles of the invention and, together with the description of the invention, explain such implementations. The drawings are not necessarily to scale, the emphasis instead being placed upon illustrating the principles of the invention.

FIGS. 13A to 13H are schematic illustrations showing a driving mode table according to an embodiment of the invention; and FIG. 14 is a look-up table in an embodiment of the invention.

DETAILED DESCRIPTION

The following description refers to the accompanying drawings. Among the various drawings the same reference numbers may be used to identify the same or similar elements. While the following description provides a thorough understanding of the various aspects of the claimed invention by setting forth specific details such as particular structures, architectures, interfaces, and techniques, such details are provided for purposes of explanation and should not be viewed as limiting. Moreover, those of skill in the art will, in light of the present disclosure, appreciate that various aspects of the invention claimed may be practiced in other examples or implementations that depart from these specific details. At certain junctures in the following disclosure descriptions of well known devices, circuits, and methods have been omitted to avoid clouding the description of the present invention with unnecessary detail.

With reference to FIGS. 5 to 7E, an image display method of a liquid crystal display (LCD) device according to one embodiment of the invention will be described.

Figure 1:
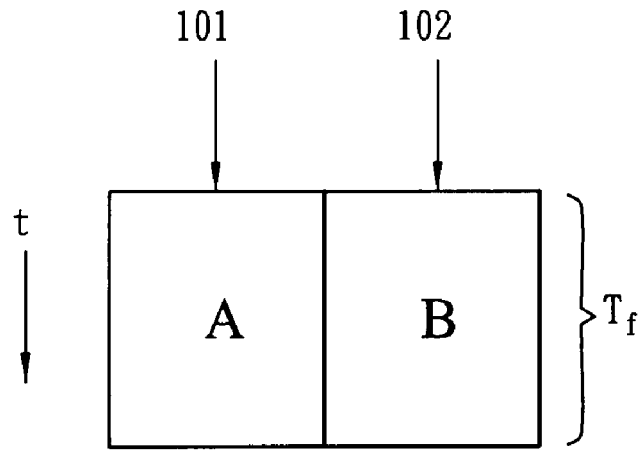
FIG. 1(PRIOR ART)
FIG. 1 is a schematic illustration showing two conventional pixels for respectively receiving gray-scale data.
Figure 2:
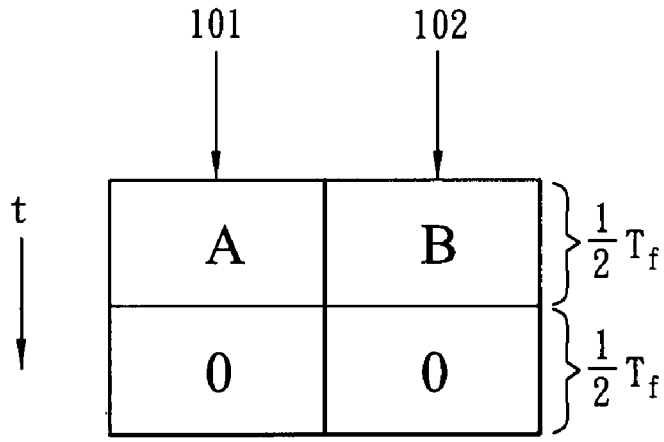
FIG. 2(PRIOR ART)
FIG. 2 is a schematic illustration showing two pixels for receiving gray-scale data and doubling the frequency according to a first conventional method.
Figures 3, 4:
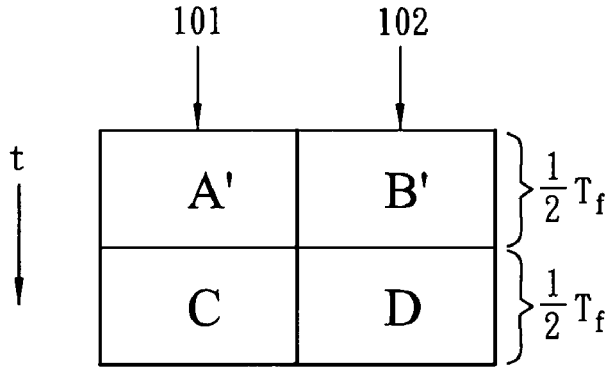
FIG. 3(PRIOR ART)
FIG. 4(PRIOR ART)
FIG. 3 is a schematic illustration showing two pixels for receiving gray-scale data and doubling the frequency according to a second conventional method.
FIG. 4 shows a look-up table for doubling the frequency according to the second conventional method.
Figure 5:
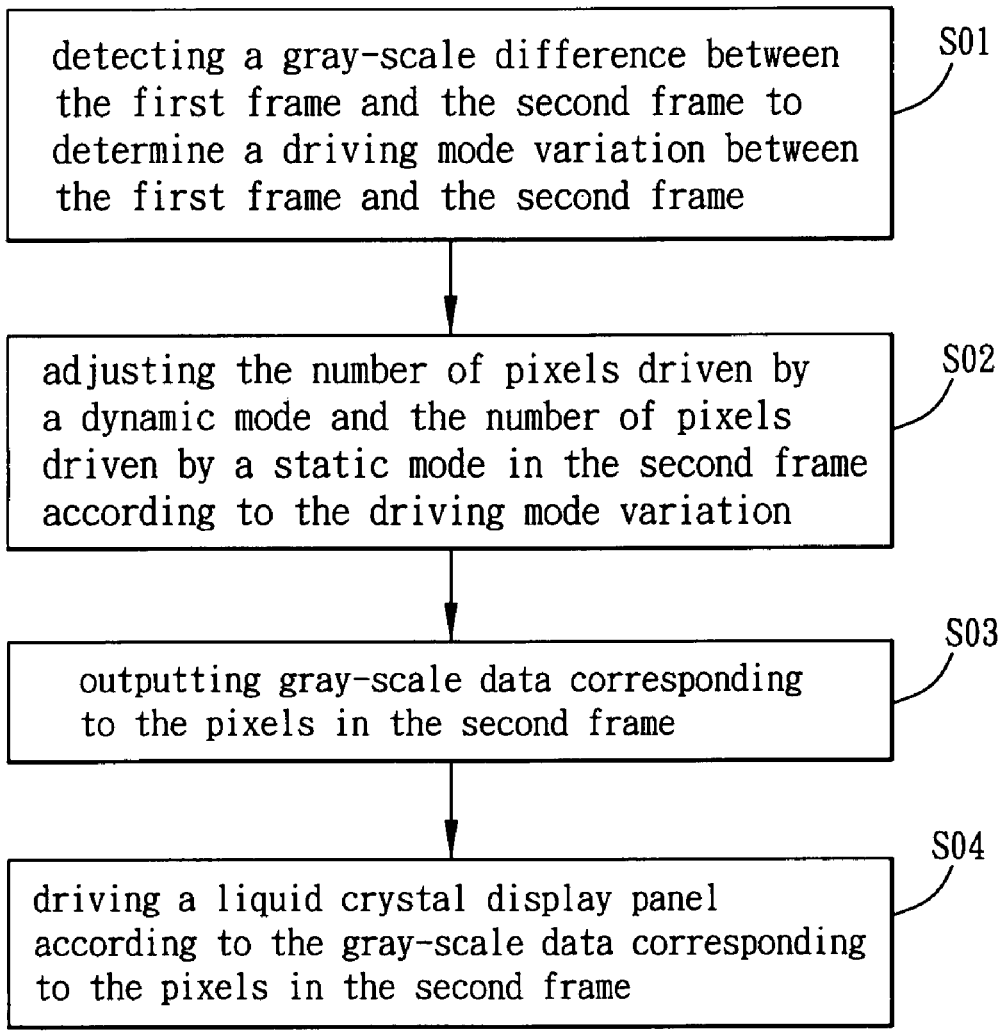
FIG. 5 is a flow chart showing an image display method of a LCD device according to an embodiment of the invention.

As shown in FIG. 5, the image display method of the LCD device according to an embodiment of the invention is to drive pixels when displaying a first frame and a second frame in sequence. The sequence may entail one frame immediately followed by a second frame. However, in other embodiments a third frame may be between the first and second sequential frames. The image display method generally includes steps S01 to S04.

In step S01, a gray-scale difference between the first frame and the second frame is detected to determine a driving mode variation between the first frame and the second frame.

In step S02, the number of pixels driven by a dynamic mode and the number of pixels driven by a static mode in the second frame is adjusted according to the driving mode variation.

In step S03, gray-scale data corresponding to the pixels in the second frame is output.

In step S04, a liquid crystal display panel is driven according to the gray-scale data corresponding to the pixels in the second frame.

The following operation is made in order to eliminate or reduce the surge that results from frame driving mode variation and the sudden change of the frame luminance that may be sensed by the viewer. Driving mode variation includes switching, in either direction, between static mode and dynamic mode. When the frame driving mode is changed, the image display method of an embodiment of the invention adjusts the number of pixels driven by the dynamic mode and the number of pixels driven by the static mode in the next frame, or adjusts the ratio of the number of pixels driven by the dynamic mode to the number of pixels driven by the static mode in the next frame. In one embodiment of the present invention, the driving mode of all the pixels in the whole frame is gradually switched from the dynamic mode to static mode or from static mode to dynamic mode, instead of suddenly switching the driving mode of all the pixels in the whole frame to dynamic mode or static mode as practiced in conventional methods. For instance, according to some embodiments, the driving modes of certain pixels in the frame may be different from the driving modes of other pixels in the frame. A pixel driven by the dynamic mode may use the conventional gray insertion technology to display the image signal, and a pixel driven by the static mode may not use the gray insertion technology to display the image signal. Thus, when the frame driving mode is changed, the sudden change of the frame luminance may be eliminated or reduced, and the generated luminance surge can be reduced.

Figure 6A:
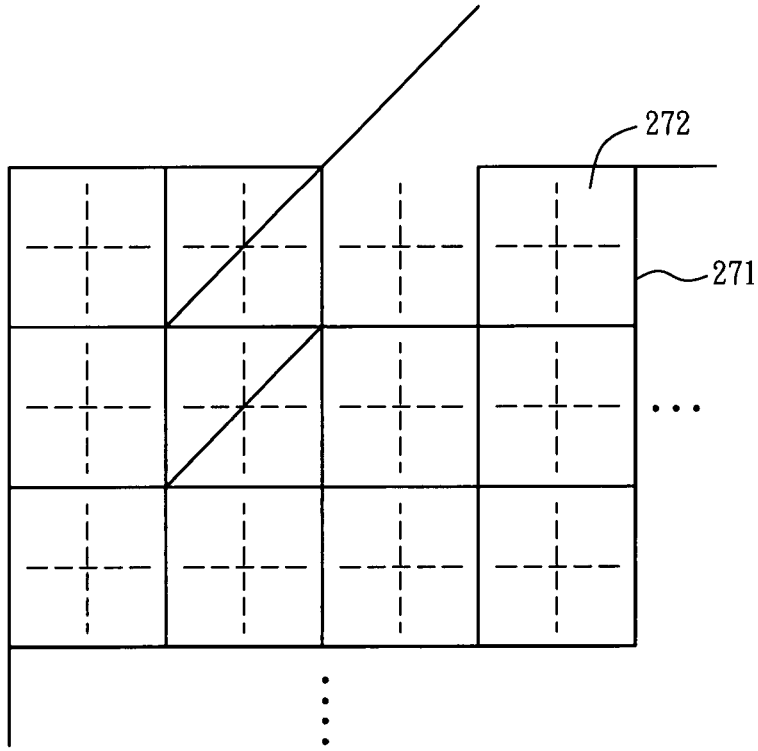
FIGS. 6A and 6B are schematic illustrations showing blocks in an image display method according to an embodiment of the invention.
Figure 6B:
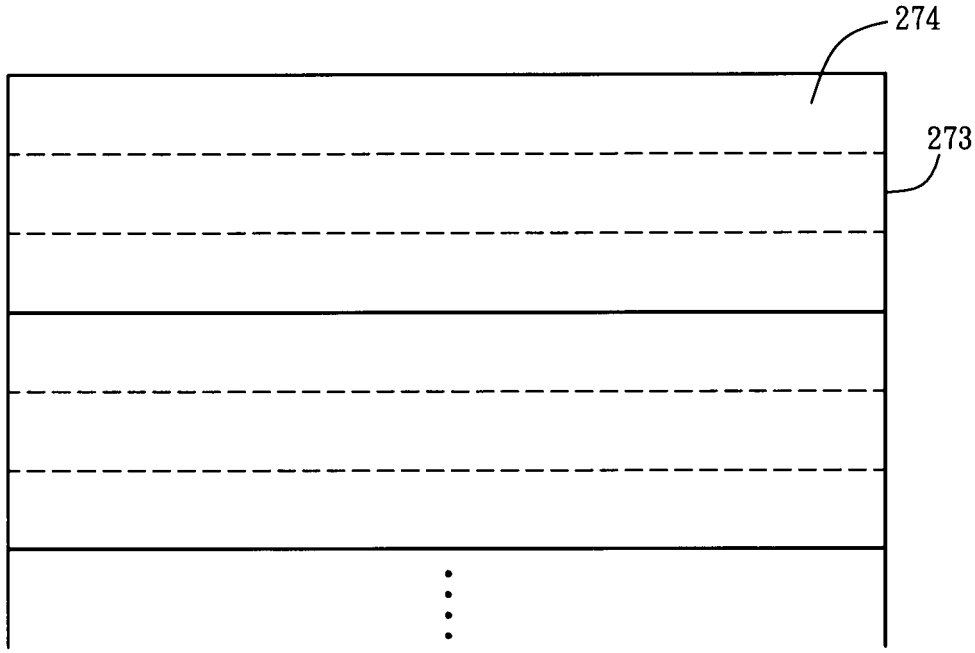

As shown in FIGS. 6A and 6B, a display frame of a LCD device may be divided into a plurality of blocks. A plurality of pixels 272 is depicted by dashed lines within each square block 271. The block serves as a basic unit for adjusting a ratio of the number of pixels driven by the dynamic mode to the number of pixels driven by the static mode (hereinafter referred to as the dynamic/static pixel ratio). In addition, the block does not have to be a square matrix. As shown in FIG. 6B, the block 273 may be composed of many columns of pixels 274 (i.e., rectangular matrix) or alternatively, can have some other geometric shape.

Figure 7A:
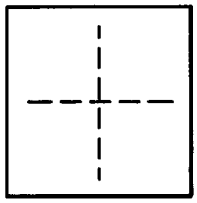
FIGS. 7A to 7E are schematic illustrations showing each block in an image display method according to an embodiment of the invention.
Figure 7B:
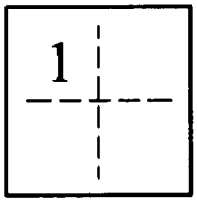

As shown in FIGS. 7A and 7B, the block according to one example is a 2×2 square matrix. Of course, the square matrix can have other sizes, such as for example, an 8×8 square matrix or rectangular matrix of other size. The image display method of the LCD device can adjust the dynamic/static pixel ratio in one block. A 2×2 square matrix, serving as one block, will provide an example discussed below.

In the example of FIG. 7A, each pixel in the block of the first frame is driven by the dynamic mode. As shown in FIG. 7B, when step S01 determines that the driving mode is converted from the dynamic mode first frame into the static mode second frame, step S02 increases the number of pixels driven by the static mode in the second frame by driving the pixel at the position 1 in the block by the static mode, and driving the pixels at the positions without reference marks by the original dynamic mode.

Figure 7C:
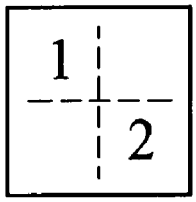
Figure 7D:
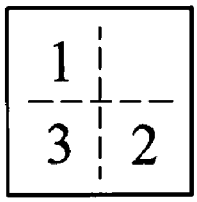
Figure 7E:
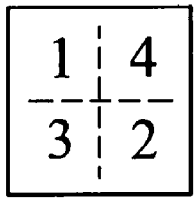

As shown in FIGS. 7C to 7E, the image display method of the LCD device further displays a third frame to a fifth frame, respectively, after the second frame of FIG. 7B. When the third frame (FIG. 7C) is processed, step S02 gradually increases the number of pixels driven by the static mode in the third to fifth frames by driving the pixels at the positions 2, 3 and 4 in the block by the static mode in sequence. In each block, the pixels at the positions without reference marks are still driven by the original dynamic mode. All the pixels in each block are driven by the static mode when the fifth frame (FIG. 7E) is displayed.

The order of appearance for the frames from FIGS. 7A to 7E is associated with the driving mode variation. When the driving mode is switched from the static mode to dynamic mode, the ratio of the pixels in the block changes in the reverse direction from FIGS. 7E to 7A. In this example, each pixel in the block in the first frame is driven by the static mode as shown in FIG. 7E. As shown in FIG. 7D, when step S01 determines that the driving mode is converted from the static mode (first frame) into the dynamic mode (second frame), step S02 decreases the number of the pixels driven by the static mode in the second frame by driving the pixel with the reference mark 4 (shown in FIG. 7E but not in FIG. 7D) in each block by the dynamic mode and driving the pixels at the positions with other reference marks by the original static mode.

As shown in FIGS. 7C to 7A, the image display method of the LCD device further displays the third to fifth frames after the second frame. When the third frame is processed, step S02 gradually decreases the number of pixels driven by the static mode in the third to fifth frames by driving the pixels at the positions without reference marks by the dynamic mode in each block in sequence. In each block, the pixels at the positions without reference marks are still driven by the original static mode. All the pixels are driven by the dynamic mode when the fifth frame (see FIG. 7A) is displayed.

In addition, when each pixel in the block is not completely driven by the static mode or the dynamic mode and the ratio is adjusted due to the frame driving mode being changed, the dynamic/static pixel ratio only has to be adjusted in a reverse direction.

For example, the frame driving mode may be changed from the dynamic mode to the static mode, and then changed back to the dynamic mode in, for example, the third frame (FIG. 7C). Specifically, the number of pixels driven by the static mode in the block may be increased according to the order from FIGS. 7A to 7C, and the number of pixels driven by the static mode in the block only has to be decreased according to the order from FIGS. 7C to 7A when the frame driving mode is changed back from the static mode to the dynamic mode. Similarly, when the frame driving mode is first changed from the static mode to the dynamic mode and then the frame driving mode is further changed from the dynamic mode back to the static mode, only the number of the pixels driven by the static mode in each block has to be increased.

Figure 8:
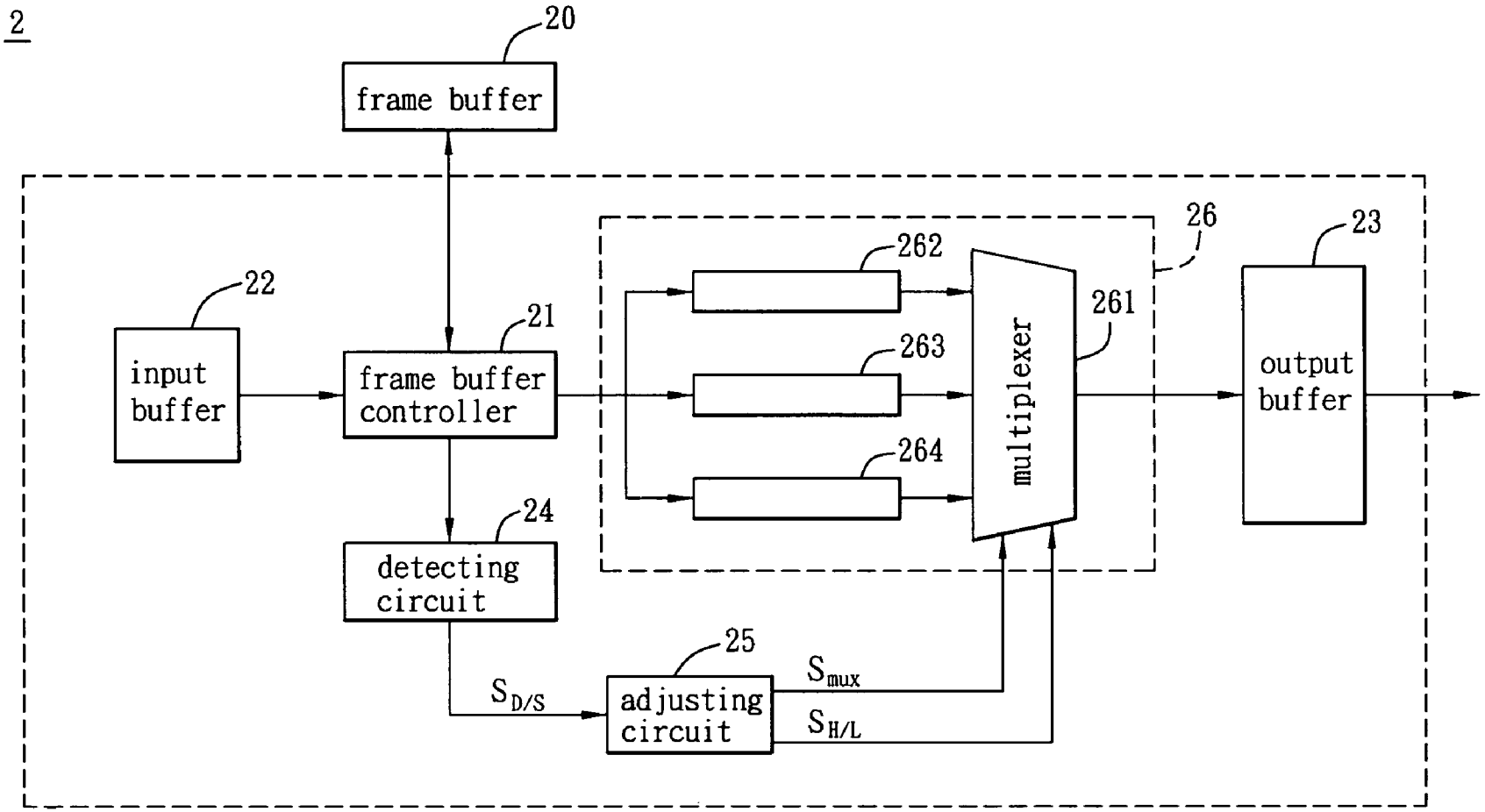
FIG. 8 is a schematic illustration showing a LCD device according to an embodiment of the invention.

According to an embodiment of the invention as shown in FIG. 8, a LCD device 2 may include a frame buffer 20, a frame buffer controller 21, an input buffer 22, an output buffer 23, a detecting circuit 24, an adjusting circuit 25 and a gray-scale converting circuit 26.

The frame buffer controller 21, electrically connected to the input buffer 22, may store frame data received by the input buffer 22 and/or frame buffer 20. The frame buffer controller 21 may provide frame data from the frame buffer 20 to the detecting circuit 24 and the gray-scale converting circuit 26.

The detecting circuit 24 may detect a gray-scale difference between successive frames (between frames $F_{m-1}$ and $F_m$) to determine a driving mode variation between the frames $F_{m-1}$ and $F_m$. Detecting circuit 24 may output a driving mode conversion determining signal $S_{D/S}$. The adjusting circuit 25, electrically connected to detecting circuit 24, may adjust the number of pixels driven by a dynamic mode and the number of pixels driven by a static mode in the frame $F_m$ (or a ratio of the number of pixels driven by a dynamic mode to the number of pixels driven by a static mode in the frame $F_m$) according to the driving mode conversion determining signal $S_{D/S}$. The gray-scale converting circuit 26, electrically connected to the adjusting circuit 25, may output the gray-scale data corresponding to each pixel.

When the gray-scale converting circuit 26 processes the frame $F_m$, the detecting circuit 24 and the adjusting circuit 25 may adjust the ratio of the number of pixels driven by the dynamic mode to the number of pixels driven by the static mode in the frame $F_m$ or adjust the number of pixels driven by the dynamic mode and the number of pixels driven by the static mode in the frame $F_m$ according to the driving mode variation between the frames $F_{m-1}$ and $F_m$.

The frame data may be input from the input buffer 22 and then output to a data line driving circuit (not shown) from the output buffer 23. The data line driving circuit may output the frame data to a storage capacitor of each pixel on a liquid crystal display panel so as to control the tilting angle of the corresponding liquid crystal molecules.

In one embodiment of the invention, the detecting circuit 24 may subtract the values of the gray-scale data of the pixel in the frame $F_{m-1}$ from the values of the gray-scale data of the pixel in the frame $F_m$ to obtain a plurality of gray-scale differences, sum the gray-scale differences, or, for example, the absolute values of the gray-scale differences, to obtain a summed difference, and compare the summed difference with a threshold value such as, for example, (maximum gray level)×(resolution of the display)×3×(1/20), to generate the driving mode conversion determining signal $S_{D/S}$ to determine whether the driving mode between the frames $F_{m-1}$ and $F_m$ is different.

When the frame $F_{m-1}$ is driven by the dynamic mode and the frame $F_m$ is driven by the static mode, the driving mode conversion determining signal $S_{D/S}$ may be at a first level. When the frame $F_{m-1}$ is driven by the static mode and the frame $F_m$ is driven by the dynamic mode, the driving mode conversion determining signal $S_{D/S}$ may be at a second level.

Figures 9, 10A, 10B, 10C, 10D:
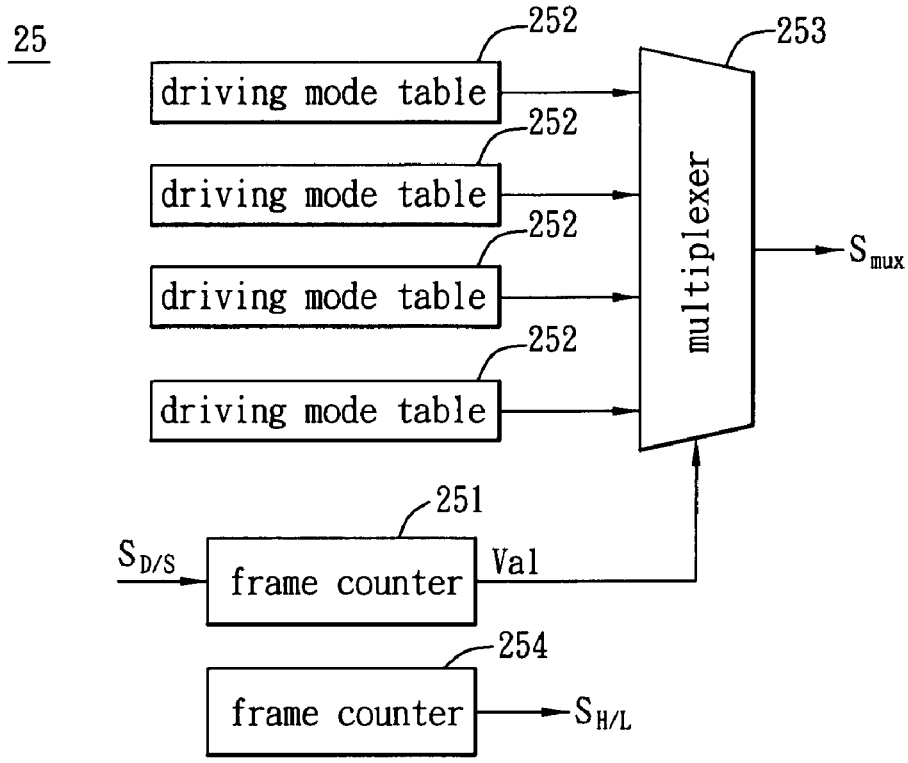
FIG. 9 is a schematic illustration showing an adjusting circuit in FIG. 8 according to an embodiment of the invention.
FIGS. 10A to 10D are schematic illustrations showing a driving mode table of FIG. 9 according to an embodiment of the invention.

Referring to FIG. 9, the adjusting circuit 25 may further include a frame counter 251, a plurality of driving mode tables (or matrix tables) 252, a multiplexer 253 and another frame counter 254 in one embodiment of the invention. The frame counter 251 may count the number of frames after the frame $F_m$ and output a count value Val. The driving mode table 252 may record information on the number and position of pixels in the block driven by the static mode and the dynamic mode, wherein the ratios and position of pixels in the driving mode tables are different from each other. The multiplexer 253 may select one of the driving mode tables 252 according to the count value Val and thus output a pixel driving mode switching signal $S_{mux}$.

As shown in FIGS. 8 and 9, the frame counter 251 may be electrically connected to the detecting circuit 24 to receive the driving mode conversion determining signal $S_{D/S}$. When the driving mode conversion determining signal $S_{D/S}$ changes, the frame counter 251 may be triggered and thus initialized. If the driving mode conversion determining signal $S_{D/S}$ is at the first level, the frame counter 251 may be initialized to a minimum, and the count value Val plus 1 may serve as the output after one frame time (e.g., 1/60 Hz). If the driving mode conversion determining signal $S_{D/S}$ is at the second level, the frame counter 251 may be initialized to a maximum, and the count value Val minus 1 may serve as the output after one frame time.

The driving mode tables 252 and the block may have the same size in one embodiment of the invention. For example, if the block is a 2×2 square matrix, the adjusting circuit 25 may have four driving mode tables 252 and information recorded in each driving mode table 252 as shown in FIGS. 10A to 10D. In the driving mode table 252, the pixel at the position labeled with "1" in the block is driven by the static mode, and the pixel at the position labeled with "0" in the block is driven by the dynamic mode. The numbers of the reference marks "1" in each driving mode table 252 may be different.

The multiplexer 253 may select one of the driving mode tables 252 according to the count value Val, and output the values of the reference marks of the driving mode tables 252 in a column-by-column and row-by-row manner to serve as the pixel driving mode switching signal $S_{mux}$.

When the driving mode is converted from the dynamic frame $F_{m-1}$ into the static frame $F_m$, the count value Val may be increased, and the count values Val in the following frames $F_{m+1}$ and $F_{m+2}$ may be gradually increased. Thus, the multiplexer 253 may select, frame-by-frame, the driving mode table 252 with increasingly larger number of reference marks "1" as the output so as to increase the number of the pixels driven by the static mode gradually. When the count value Val reaches the maximum, it may represent that all the pixels are driven by the static mode.

On the other hand, when the driving mode is converted from the static frame $F_{m-1}$ into the dynamic frame $F_m$, the count value Val may be decreased, and the count values Val in the following frames $F_{m+1}$ and $F_{m+2}$ may be gradually decreased. Thus, the multiplexer 253 may select, frame-by-frame, the driving mode table 252 with the larger number of the reference marks "0" as the output so as to decrease the number of the pixels driven by the static mode gradually. When the count value Val reaches the minimum, it may represent that all the pixels are driven by the dynamic mode.

In addition, as will be discussed further below, the other frame counter 254 may continuously switch a level of a sub-frame switching signal $S_{H/L}$ during two sub-frames of one frame.

In one embodiment of the invention, the adjusting circuit 25 may have eight driving tables 252 and information recorded in each driving mode table 252 as shown respectively in, for example, FIGS. 13A to 13H. In the driving mode table of an 8×8 matrix, the pixels at the positions labeled with "1" in the block may be driven by the static mode, and the pixels at the positions labeled with "0" in the block may be driven by the dynamic mode. The numbers of the reference marks "1" in each driving mode table 252 may be different. In this embodiment, the driving mode of eight pixels in each block is simultaneously changed from static mode to dynamic mode every frame. For example, eight additional pixels are driven in the dynamic mode in FIG. 13B as compared to FIG. 13A.

Furthermore, the contents of the driving mode table 252 corresponding to each pixel may change once every frame in one embodiment of the invention. Taking the driving mode table of square matrix for example, the matrix may be rotated by 90 degrees to change the contents of the driving mode table (i.e., position of each pixel driven by different methods in the block) and to prevent a fixed pattern from being generated when the image is being displayed. When the driving mode table 252 is composed of plural columns of pixels, the positions of the columns may be arbitrarily or sequentially changed to change the contents of the driving mode table (i.e., position of each pixel driven by different methods in the block). In addition, the driving mode table 252 may also be replaced with a random number generating table. That is, the contents of the driving mode table (i.e., positions of the pixels driven by the static/dynamic mode in the block) are not fixed.

Referring again to FIG. 8, the gray-scale converting circuit 26 may include a multiplexer 261, a dynamic high gray-scale table 262, a dynamic low gray-scale table 263 and a static gray-scale table 264. The gray-scale data corresponding to the pixel driven by the static mode may be determined according to the static gray-scale table 264. The gray-scale data corresponding to the pixel driven by the dynamic mode is determined according to the dynamic high gray-scale table 262 and the dynamic low gray-scale table 263. In one embodiment of the invention, the static gray-scale table 264 corresponds to the gray-scale value of the original image video data; the gray-scale value recorded in the dynamic high gray-scale table 262 is brighter than the gray-scale value of the original image video data; and the gray-scale value recorded in the dynamic low gray-scale table 263 is darker than the gray-scale value of the original image video data, or is the blacker gray-scale value.

The multiplexer 261 may select the gray-scale data determined by one of the static gray-scale table 264, the dynamic high gray-scale table 262 and the dynamic low gray-scale table 263 as the output according to the pixel driving mode switching signal $S_{mux}$ output from the driving mode table 252. When the pixel at some position in the block is driven by the static mode, the multiplexer 261 selects the gray-scale data from the static gray-scale table 264 as the output in one frame period. When the pixel at some position in the block is driven by the dynamic mode, the multiplexer 261 sequentially selects the gray-scale data from the dynamic high gray-scale table 262 and the dynamic low gray-scale table 263 as the output in successive sub-frames of one frame period according to the sub-frame switching signal $S_{H/L}$. The output may be provided to the data line driving circuit so that the liquid crystal display panel can show the image normally. Thus, a portion of the pixels is driven by the dynamic mode, and the other portion of the pixels is driven by the static mode simultaneously.

Figure 11:
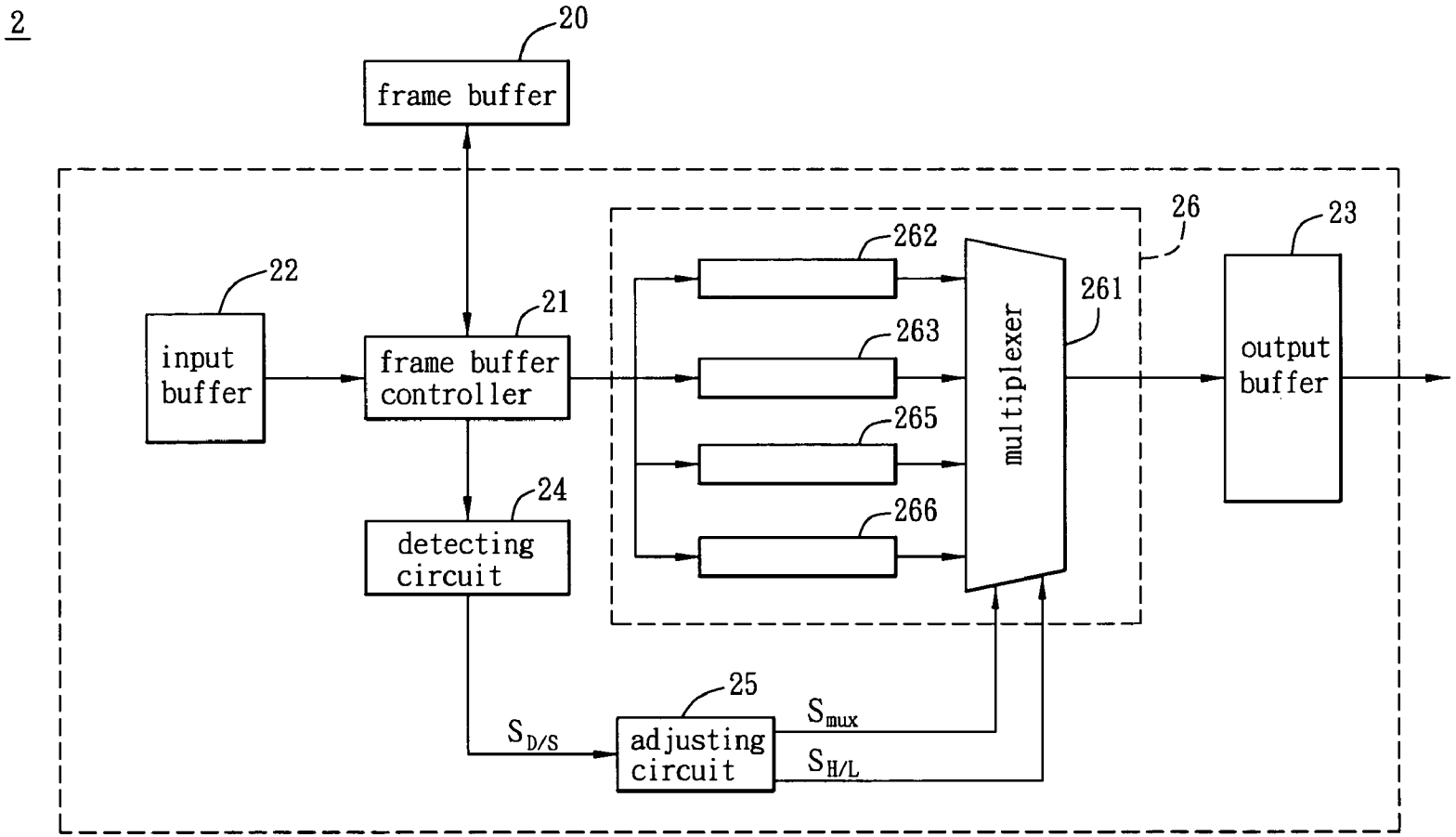
FIG. 11 is a schematic illustration showing a LCD device according to another embodiment of the invention.

In another embodiment of the invention, as shown in FIG. 11, the static gray-scale table 264 may also be replaced with a static high gray-scale table 265 and a static low gray-scale table 266. That is, in the static driving mode, the pixel may be driven in a manner similar to the dynamic mode, but the gray-scale difference between the static high gray-scale table 265 and the static low gray-scale table 266 may be smaller. Herein, the multiplexer 261 may select the gray-scale data from the static high gray-scale table 265, the static low gray-scale table 266, the dynamic high gray-scale table 262 and the dynamic low gray-scale table 263 to serve as the output according to the pixel driving mode switching signal $S_{mux}$ output from the driving mode table 252. When the pixel at some position is driven by the static mode, the multiplexer 261 may sequentially select the gray-scale data from the static high gray-scale table 265 and the static low gray-scale table 266 as the output in successive sub-frames of one frame period according to the sub-frame switching signal $S_{H/L}$. When the pixel at some position is driven by the dynamic mode, the multiplexer 261 may sequentially select the gray-scale data found from the dynamic high gray-scale table 262 and the dynamic low gray-scale table 263 as the output in one frame period according to the sub-frame switching signal $S_{H/L}$.

Figure 12:
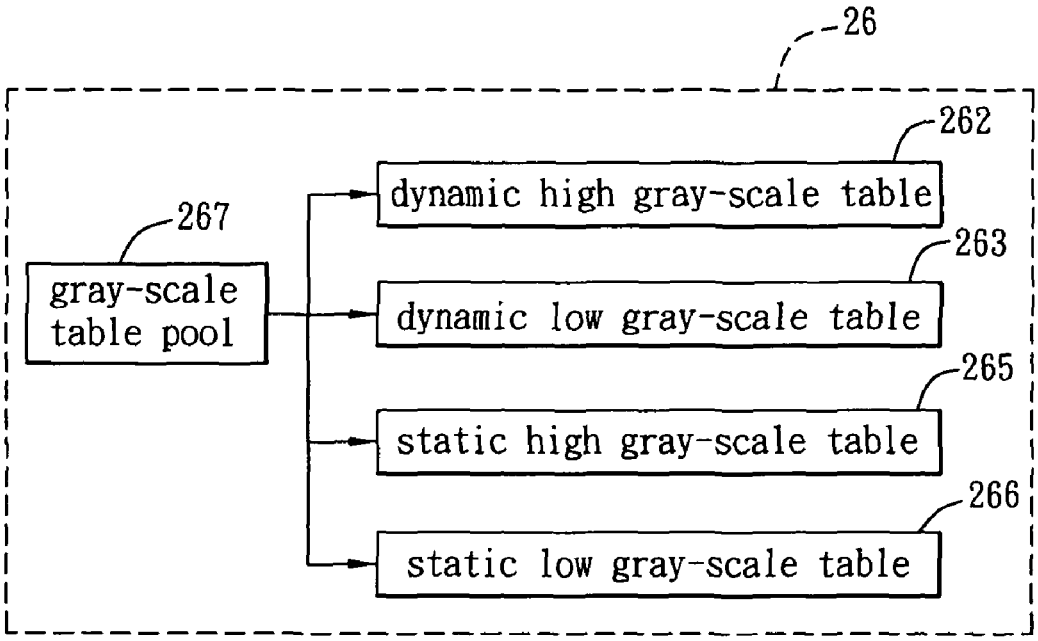
FIG. 12 is a schematic illustration showing a gray-scale converting circuit of FIG. 11 according to an embodiment of the invention.

FIG. 12 shows an embodiment of the gray-scale converting circuit 26 in FIG. 11 according to one embodiment of the invention. Referring to FIG. 12, the gray-scale converting circuit 26 further comprises a gray-scale table pool (or look up table (LUT) pool) 267 for storing a plurality of gray-scale tables to be read by the dynamic high gray-scale table 262, the dynamic low gray-scale table 263, the static high gray-scale table 265 and the static low gray-scale table 266. Thus, the dynamic high gray-scale table 262, the dynamic low gray-scale table 263, the static high gray-scale table 265 and the static low gray-scale table 266 may be updated in a frame-by-frame manner, a column-by-column manner, a row-by-row manner or a pixel-by-pixel manner. Here, the gray-scale value recorded in the static high gray-scale table 265 and static low gray-scale table 266 may correspond to the gray-scale value of the original image video data and may be substantially the same. FIG. 14 shows one embodiment of the static high gray-scale table 265 and static low gray-scale table 265 according to the invention.

In another embodiment of the invention, the detecting circuit 24 may compare the value of the gray-scale data of the pixel in the frame $F_{m-1}$ and the value of the gray-scale data of the pixel in the frame $F_m$ to determine if the pixel changes the gray-scale data in successive frames, accumulate the number of pixels changing the gray-scale data to obtain a total number, and compare the total number with a threshold value such as, for example, (resolution of the display)×3×(1/20), to determine whether the driving mode between the frames $F_{m-1}$ and $F_m$ is different.

Therefore, in one embodiment of the invention, the LCD device and the image display method may adjust the number of pixels driven by the dynamic mode and the number of pixels driven by the static mode (or the ratio of the number of pixels driven by the dynamic mode to the number of pixels driven by the static mode) in the second frame instead of driving all pixels in the second frame by the dynamic mode or the static mode when the driving mode is changed between the first frame and the second frame. Consequently, it is possible to prevent the sudden change of the luminance of the image when the driving mode is changed. Thus, the viewer may not easily sense the surge generated in the image.

Although the invention has been described with reference to specific embodiments, this description is not meant to be construed in a limiting sense. Various modifications of the disclosed embodiments, as well as alternative embodiments, will be apparent to persons or ordinary skill in the art. It is, therefore, contemplated that the appended claims will cover all modifications that fall within the true scope of the invention.

What is claimed is:

1. A method of driving a plurality of pixels of a liquid crystal display (LCD) device when displaying a first frame and a second frame in sequence, the method comprising:

detecting a gray-scale difference between the first frame and the second frame;

determining a driving mode change between the first frame and the second frame based on the detected gray-scale difference;

adjusting a ratio of first pixels, which are driven by a dynamic mode and are included in the plurality of pixels, to second pixels, which are driven by a static mode and are included in the plurality of pixels, in the second frame based on the determined driving mode change; and outputting gray-scale data based on the adjusted ratio;

wherein outputting the gray-scale data comprises: (a) counting the number of frames since the first frame is output; (b) determining a count value based on the counted number of frames; (c) selecting one of a plurality of driving mode tables based on the count value; (d) determining whether an additional plurality of pixels included in the plurality of pixels are driven in the static mode or the dynamic mode based on the selected driving mode table; (e) outputting the gray-scale data corresponding to the additional plurality of pixels in the second frame based on a static gray-scale table if the additional plurality of pixels is driven in the static mode; and (f) outputting the gray-scale data corresponding to the additional plurality of pixels in the second frame based on a dynamic high gray-scale table and a dynamic low gray-scale table if the additional plurality of pixels is driven in the dynamic mode.

2. The method according to claim 1, wherein the dynamic mode is to drive the first pixels based on a first signal for a first portion of the first frame and a second signal for a second portion of the first frame, the first signal being different from the second signal, and the static mode is to drive a third signal for the first portion of the first frame and a fourth signal for the second portion of the second frame, the third signal being substantially the same as the fourth signal.

3. The method according to claim 1, wherein adjusting the ratio comprises:

increasing a number of the second pixels in the second frame based on the driving mode changing from the dynamic mode of the first frame to the static mode of the second frame.

4. The method according to claim 1, further comprising displaying a third frame to an $N^{th}$ frame after the second frame, wherein N is a natural number greater than 1, and wherein adjusting the ratio comprises:

gradually increasing the number of the second pixels in the third to $(N-1)^{th}$ frames based on the driving mode changing from the dynamic mode of the first frame to the static mode of the second frame, and driving each of the plurality of pixels in the static mode in the $N^{th}$ frame.

5. The method according to claim 1, wherein adjusting the ratio comprises:

decreasing a number of the second pixels in the second frame based on the driving mode changing from the static mode of the first frame into the dynamic mode of the second frame.

6. The method according to claim 1, further comprising displaying a third frame to a $N^{th}$ frame after the second frame, wherein N is a natural number greater than 1, and adjusting the ratio comprises:

gradually decreasing a number of the second pixels in the third to $(N-1)^{th}$ frames based on the driving mode changing from the static mode of the first frame to the dynamic mode of the second frame.

7. The method according to claim 1, wherein detecting the gray-scale difference comprises:

obtaining a plurality of gray-scale differences between values of the gray-scale data of the pixels in the first frame and the second frame;

summing the plurality of gray-scale differences to obtain a summed difference; and comparing the summed difference with a threshold value to generate a driving mode change signal which is used to determine the driving mode change between the first frame and the second frame.

8. A liquid crystal display (LCD) device having a plurality of pixels to display a first frame and a second frame in sequence, the device comprising:

a detecting circuit to detect a gray-scale difference between the first frame and the second frame and output a first signal based on a driving mode variation between the first frame and the second frame;

an adjusting circuit, electrically connected to the detecting circuit, to adjust a number of pixels driven by a dynamic mode and a number of pixels driven by a static mode in the second frame based on the first signal; and a gray-scale converting circuit, electrically connected to the adjusting circuit, to output gray-scale data corresponding to the plurality of pixels based on the number of pixels driven by the dynamic mode and the number of pixels driven by the static mode in the second frame;

wherein the gray-scale converting circuit comprises:

a timer to count a number of frames after the first frame is output and to output a count value based on the counted number of frames;

a plurality of driving mode tables to each record a different ratio of the pixels driven by the static mode to the pixels driven by the dynamic mode;

a first multiplexer to select the gray-scale data from a static gray-scale table, if an additional plurality of pixels included in the plurality of pixels is driven in the static mode, and from a dynamic high gray-scale table and a dynamic low gray-scale table if the additional plurality of pixels is driven in the dynamic mode; and a second multiplexer to select a subset of the gray-scale data from the dynamic high gray-scale table and the dynamic low gray-scale table to output from the gray-scale converting circuit.

9. The device according to claim 8, wherein the adjusting circuit is to increase the number of the pixels driven by the static mode in the second frame based on the driving mode being converted from the dynamic mode of the first frame to the static mode of the second frame.

10. The device according to claim 8, wherein the device is to display a third frame to a $N^{th}$ frame after the second frame, wherein N is a natural number greater than 1, and further wherein the adjusting circuit is to gradually increase the number of the pixels driven by the static mode in the third to $N^{th}$ frames based on the driving mode being converted from the dynamic mode of the first frame to the static mode of the second frame.

11. The device according to claim 8, wherein the adjusting circuit is to decrease the number of the pixels driven by the static mode in the second frame based on the driving mode being converted from the static mode of the first frame to the dynamic mode of the second frame.

12. The device according to claim 8, wherein the device is to display a third frame to a $N^{th}$ frame after the second frame, wherein N is a natural number greater than 1, and the adjusting circuit is to gradually decrease the number of the pixels driven by the static mode in the third to $(N-1)^{th}$ frames based on the driving mode being converted from the static mode of the first frame to the dynamic mode of the second frame.

13. The device according to claim 8, wherein the detecting circuit is to obtain a plurality of gray-scale differences between values of the gray-scale data of the pixels in the first frame and the second frame, sum the plurality of gray-scale differences to obtain a summed difference, and compare the summed difference with a threshold value to generate the first signal.

14. A liquid crystal display (LCD) device, comprising:

a control circuit to determine a first ratio of pixels to be dynamically driven to pixels to be statically driven during a first frame and a second ratio of pixels to be dynamically driven to pixels to be statically driven during a second frame;

wherein the control circuit comprises: (a) a detecting circuit to detect a gray-scale difference between the first frame and the second frame to determine a driving mode variation between the first frame and the second frame and to output a driving mode conversion determining signal, (b) an adjusting circuit, to be electrically connected to the detecting circuit, to adjust a ratio of the number of pixels to be driven by a dynamic mode to the number of pixels to be driven by a static mode in the second frame based on the driving mode conversion determining signal; and (c) a gray-scale converting circuit, to be electrically connected to the adjusting circuit, to output gray-scale data corresponding to the plurality of pixels based on the ratio;

wherein the gray-scale converting circuit comprises (a) a timer to count a number of frames after the first frame is output and to output a count value based on the counted number of frames; (b) a plurality of driving mode tables to each record a different ratio for the pixels to be driven by the static mode to the pixels to be driven by the dynamic mode; (c) a first multiplexer to select gray-scale data from a static gray-scale table, if an additional plurality of pixels included in the plurality of pixels is driven in the static mode, and from a dynamic high gray-scale table and from a dynamic low gray-scale table if the additional plurality of pixels is driven in the dynamic mode; and (d) a second multiplexer to select additional gray-scale data from the selected gray-scale data from the dynamic high gray-scale table and the dynamic low gray-scale table.

15. The device according to claim 14, wherein the adjusting circuit is to increase the number of the pixels driven by the static mode in the second frame based on the driving mode being converted from the dynamic mode of the first frame to the static mode of the second frame.

16. The device according to claim 14, the device to display a third frame to a $N^{th}$ frame after the second frame, wherein N is a natural number greater than 1, and further wherein the adjusting circuit is to gradually increase the number of the pixels driven by the static mode in the third to $(N-1)^{th}$ frames based on the driving mode being converted from the dynamic mode of the first frame to the static mode of the second frame.

17. The device according to claim 14, wherein the adjusting circuit is to decrease the number of the pixels driven by the static mode in the second frame based on the driving mode being converted from the static mode of the first frame to the dynamic mode of the second frame.

18. The device according to claim 14, to device to display a third frame to a $N^{th}$ frame after the second frame, wherein N is a natural number greater than 1, and the adjusting circuit is to gradually decrease the number of the pixels driven by the static mode in the third to $N^{th}$ frames based on the driving mode being converted from the static mode of the first frame to the dynamic mode of the second frame.

19. The device according to claim 14, wherein the detecting circuit is to obtain a plurality of gray-scale differences by subtracting values of the gray-scale data of the pixels in the first frame from values of the gray-scale data of the pixels in the second frame, sum the plurality of gray-scale differences to obtain a summed difference, and compare the summed difference with a threshold value to generate a driving mode conversion determining signal and to determine the driving mode variation between the first frame and the second frame.

20. A method of driving pixels of a liquid crystal display (LCD) device when displaying a first frame and a second frame in sequence, the method comprising:

detecting a gray-scale difference between the first frame and the second frame;

determining a driving mode change between the first frame and the second frame based on the gray-scale difference;

driving (a) a first plurality of pixels each with a respective first signal during a first portion of the first frame and a respective second signal during a second portion of the first frame; and (b) a second plurality of pixels each with a respective third signal during the first portion of the first frame and a respective fourth signal during the second portion of the first frame, wherein each respective first signal is different from each respective second signal and each respective third signal is substantially the same as each respective fourth signal, and the number of the first plurality of pixels in the first frame is different from the number of the first plurality of pixels in the second frame; and outputting gray-scale data, wherein outputting the gray-scale data comprises: (a) counting the number of frames since the first frame is output; (b) determining a count value based on the counted number of frames; (c) selecting one of a plurality of driving mode tables based on the count value; (d) determining whether an additional plurality of pixels are driven in the static mode or the dynamic mode based on the selected driving mode table; (e) outputting the gray-scale data corresponding to the additional plurality of pixels in the second frame based on a static gray-scale table if the additional plurality of pixels is driven in the static mode; and (f) outputting the gray-scale data corresponding to the additional plurality of pixels in the second frame based on a dynamic high gray-scale table and a dynamic low gray-scale table if the additional plurality of pixels is driven in the dynamic mode.

* * * * *